US005511362A

United States Patent [19]

Morita et al.

[11] Patent Number: 5,511,362

[45] Date of Patent: Apr. 30, 1996

[54] BOX SEALING METHOD AND APPARATUS

[75] Inventors: Shigeru Morita, Iruma; Hirsohi Ishida, Tsurugaoka; Isao Hirano, Saitamaa, all of Japan

[73] Assignee: Nippon Flute Co., Ltd., Japan

[21] Appl. No.: 156,750

[22] Filed: Nov. 24, 1993

[51] Int. Cl.[6] ..... B65B 43/26

[52] U.S. Cl. ..... 53/491; 53/136.4; 53/415; 493/180; 493/183

[58] Field of Search ..... 156/468, 475, 156/477.1, 486; 493/180, 183, 316, 963; 53/136.3, 136.4, 376.4, 378.3, 415, 491

[56] References Cited

U.S. PATENT DOCUMENTS

| | | | |
|---|---|---|---|
| 3,236,022 | 2/1966 | Loveland, et al. | 53/136.4 |
| 4,262,469 | 4/1981 | Ooms et al. | 53/136.4 |
| 4,525,980 | 7/1985 | Ulrich et al. | 53/491 |
| 4,585,504 | 4/1986 | Marchetti | 53/136.4 |
| 4,748,794 | 6/1988 | Marchetti | 53/136.4 |
| 4,821,487 | 4/1989 | James et al. | 53/415 |
| 4,889,581 | 12/1989 | Ulrich et al. | 53/136.4 |
| 4,955,177 | 9/1990 | Lerner et al. | 493/183 |
| 5,079,900 | 1/1992 | Pinckney et al. | 53/415 |

*Primary Examiner*—W. Donald Bray
*Attorney, Agent, or Firm*—Bradford E. Kile; Ruffin B. Cordell; Michael J. McKeon

[57] ABSTRACT

A box forming apparatus for folding and securing the upper flaps of a box including a front inner flap folding body, back inner flap folding body, and left and right outer flap folding bodies for moving the respective flaps of a box into its upper opening plane. The novel apparatus further includes a cooperating tape head for securing the flaps in their folded position.

12 Claims, 4 Drawing Sheets

BOX SEALING METHOD AND APPARATUS

BACKGROUND OF THE INVENTION

This invention relates to box sealing equipment. More particularly, this invention relates to a box sealing method and equipment which automatically folds upper box flaps and seals the flaps with tape to produce a closed, sealed box. This application is related to the subject matter of prior U.S. Pat. No. 4,915,678 of common assignment with the subject application. The subject matter of this application is further related to co-pending U.S. patent application Ser. No. 08/156,820 entitled "Box Forming Equipment" filed Nov. 24, 1993.

In the past after materials were packaged in a box body with an open upper portion, box sealing equipment closed the box by folding the front inner flap, the back inner flap, and left and right outer flaps. The top opening plane of the box was then sealed by binding the left and right outer flaps with self-adhering. Specifically, while the box was being conveyed, the front inner flap was folded by a front inner flap folding body located ahead of the box body, and the back flap was folded by a back inner flap folding body which swings from behind the box body to the box body. The left and right outer flaps were then folded by left and right outer flap folding bodies, located at the both the left and right sides of the box body. Finally, the facing edges of the left and right outer flaps were sealed with single-sided adhesive tape.

Although prior box sealing methods and equipment have been utilized with some success, previoulsly known equipment has been designed to fold the upper box flaps while the box body is moving. Therefore, previously known equipment must be quite large relative to the size of the box to be sealed. Additionally, prior box sealing equipment applied force to the left and right outer flaps perpendicular to the direction of box movement. Accordingly, the left and right outer flaps may be twisted, folded inaccurately, and/or improperly sealed, causing previously known box sealing machinery to lack reliability at speed. Further, prior box sealing machinery tended to present danger to packaging operators because of the large sweeping motion of the swinging-type back inner flap folding body.

The difficulties suggested in the preceding are not intended to be exhaustive, but rather are among many which may tend to reduce the effectiveness and satisfaction with prior box sealing machines. Other noteworthy problems may also exist; however, those presented above should be sufficient to demonstrate that equipment and methods appearing in the past will admit to worthwhile improvement.

OBJECTS AND BRIEF SUMMARY OF THE INVENTION

Objects

It is therefore a general object of the invention to provide a novel box forming method and apparatus which will obviate or minimize difficulties of the type previously described.

It is a specific object of the invention to provide a novel, box forming method and apparatus which is compact and efficient in design and operation.

It is another object of this invention to provide a reliable box sealing method and mechanism which decreases the potential that box flaps will be twisted and improperly sealed.

It is a further object of this invention to provide a box sealing method and mechanism which assures safety to its operators.

It is still a further object of his invention to provide a novel box sealing method and apparatus which is operable to form a box with a closed top in a condition for subsequent transport.

BRIEF SUMMARY OF A PREFERRED EMBODIMENT

A preferred embodiment of the invention intended to accomplish at least some of the foregoing objects comprises a conveyer which transports a box with an open upper portion. A stopper is installed which advances and retreats with respect to the transporting plane of the conveyer. A longitudinal, thin, and flat front inner flap, push down body is located slightly above the base of the front inner flap, at a position corresponding to the central portion of the box body and folds the front inner box flap into the top opening plane of the box. A lateral, flat back, inner flap, push down body rotates from an upward position to a near horizontal position around a rotation shaft projected behind the back inner box flap and folds the back inner box flap into the top opening plane of the box. A pair of left and right outer flap push, down bodies, composed of bearing rollers, rotate downward around a rotation shaft located above a central part of the box body to fold the right and left outer flaps into the top opening plane of the box while the rollers rotate on the surface of the flaps. After the stopper is released, a tape head, located behind the front inner flap push down body, seals the edges of the left and right outer flaps with tape while the box body is being transported. Finally, the lateral, flat back inner push down body is effortlessly extracted between the back inner flap and the left and right outer flaps while the box is moving forward.

THE DRAWINGS

Other objects and advantages of the present invention will become apparent from the following detailed description of a preferred embodiment thereof taken in conjunction with the accompanying drawings, wherein.

Figure 3:
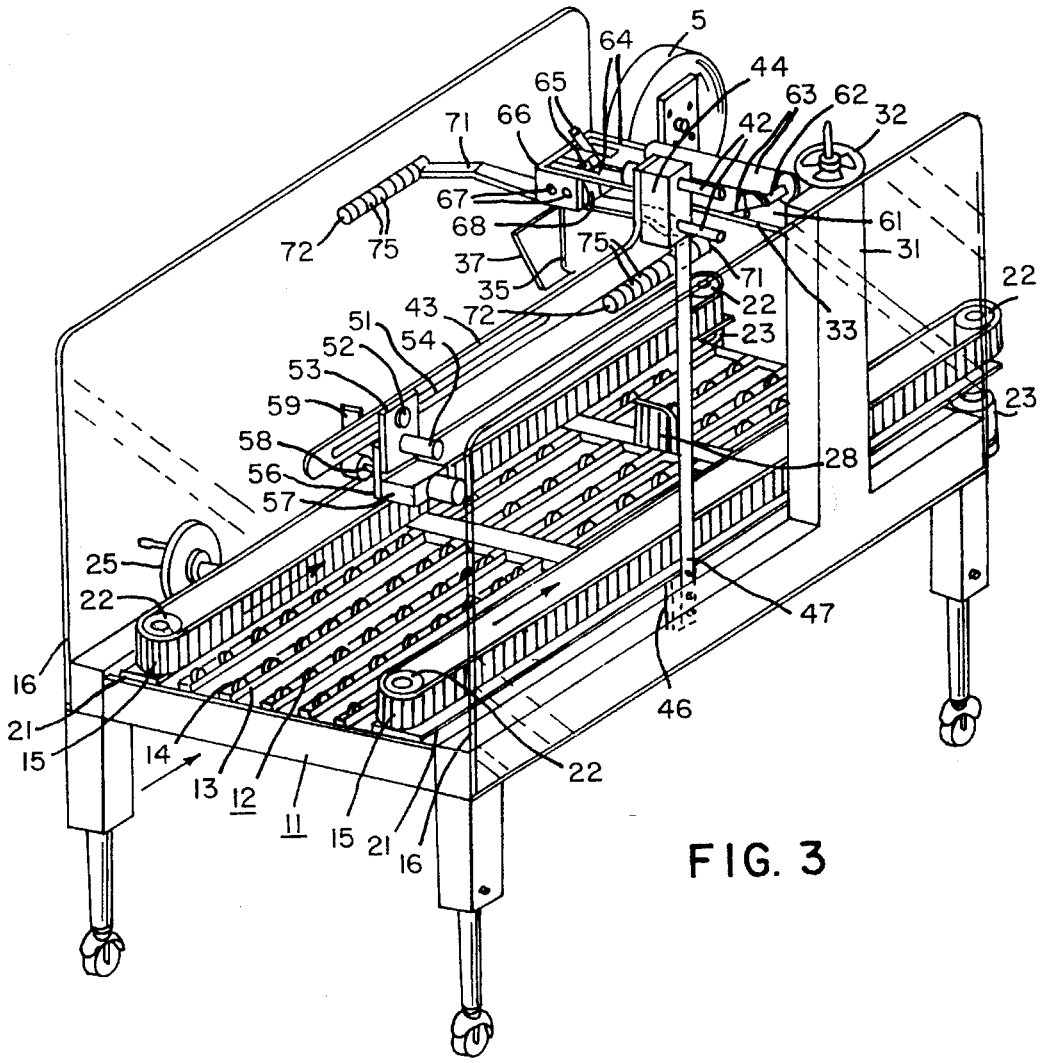
FIG. 3 is an axonometric view of the subject box sealing process.
Figure 4:
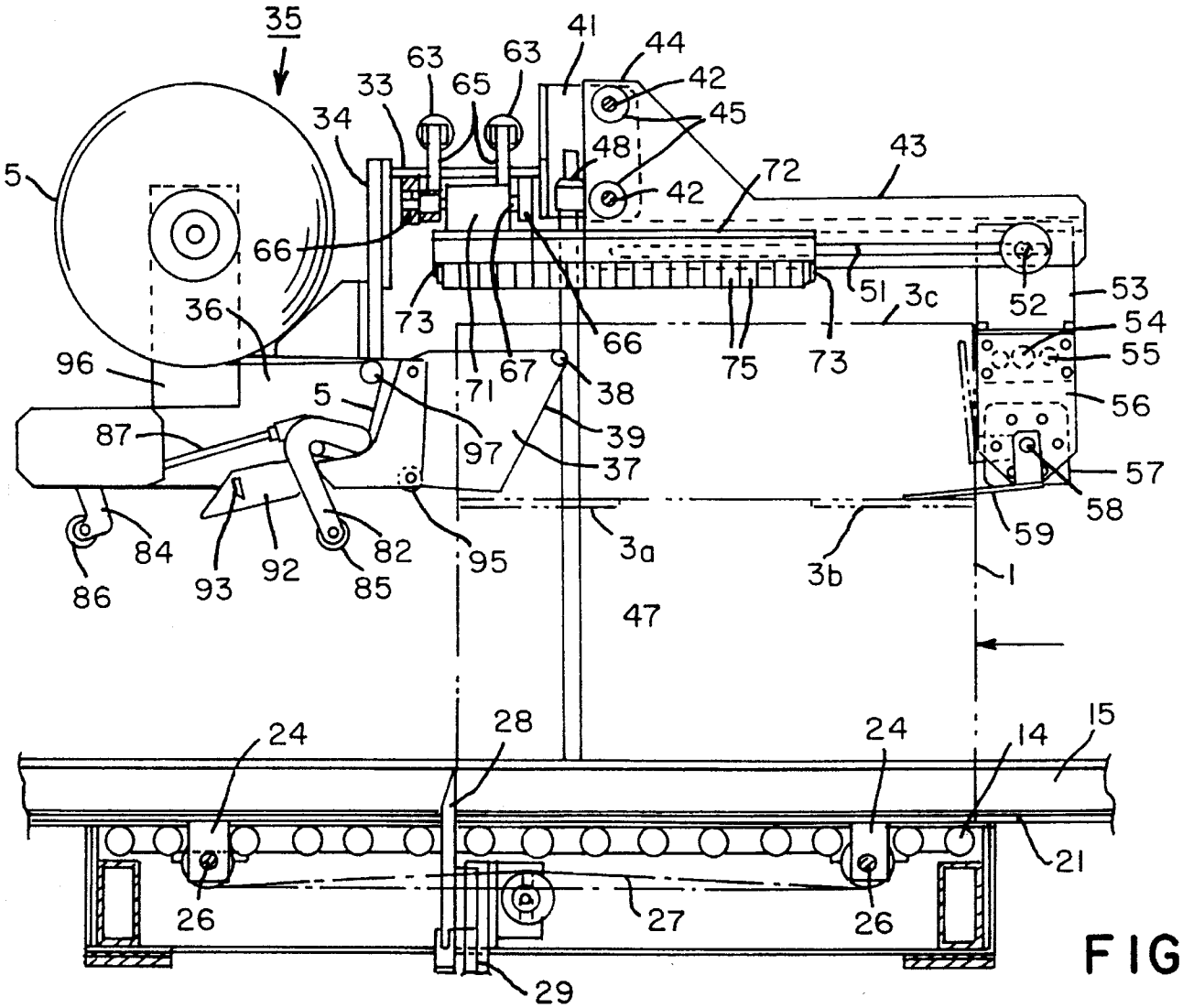
Figure 6:
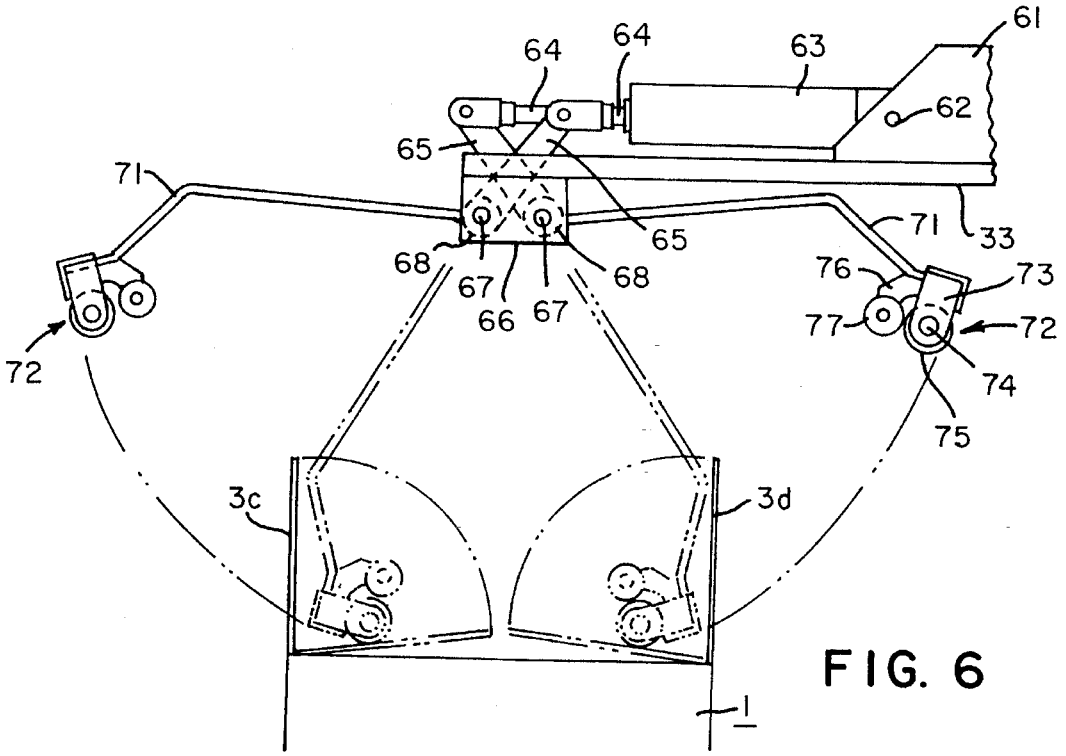
Figure 7:
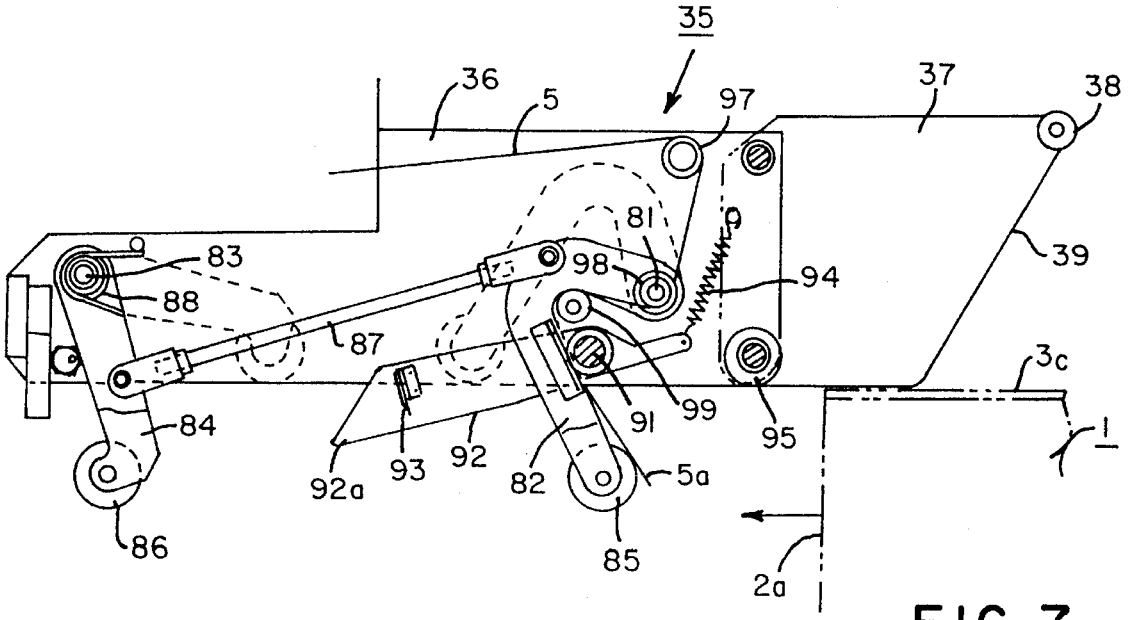

FIG. 4, note sheet 3, is a partial left side, cross-sectional, view of the box sealing equipment;

FIG. 5, note sheet 2 again, is an axonometric view of a front inner flap push down body and a back inner flap push down body of the box sealing equipment depicted in FIG. 3, without a tape head;

FIG. 6 is a front view of left and right outer flap push down arms of the box sealing equipment depicted in FIG. 3; and FIG. 7 is a partial cross-sectional, left side view of a tape head component of the box sealing equipment depicted in FIG. 3.

DETAILED DESCRIPTION

Context of the Invention

Prior to providing a detailed description of the subject invention, reference to the context of the subject invention may be worthwhile. In this connection, FIG. 1 discloses a box body 1 consisting of material such as conventional corrugated box board. The box body 1 has a box frame composed of a front end panel 2*a*, a back end panel 2*b*, and left and right side panels 2*c* and 2*d*. The upper flaps of this box frame consist of a front inner flap 3*a*, back inner flap 3*b*, and left and right outer flaps 3*c* and 3*d*, which will form the top cover of the box. These flaps are folded into a top opening plane of the box body 1 along folding lines 4*a*, 4*b*, and 4*c* and 4*d*, respectively. After materials are packaged within the box body 1, the top of which remains open, the box sealing equipment folds the front inner flap 3*a*, the back inner flap 3*b*, and the left and right outer flaps 3*c* and 3d into the top opening plane of the box body 1, note FIG. 2. The left and right outer flaps 3*c* and 3*d* are then sealed with single-sided strip of adhesive tape 5. The bottom of the box body 1 was formed earlier by folding the front and back inner lower flaps and left and right outer lower flaps (not shown in drawing) into the bottom box plane and sealing the left and right outer flaps with tape.

Box Sealing Apparatus

Turning to FIGS. 1 through 5, wherein like reference numerals indicate like parts, FIG. 3 discloses an axonometric view of a box sealing apparatus in accordance with the invention. Inside a main frame 11, a conveyer 12 carries the box body 1, note FIG. 3, with an open upper portion. The conveyer 12 consists of a box body transporting surface composed of a plurality of free rollers 14, shaft supported by roller frames 13, and a pair of opposed, endless side belts 15, which are inclined slightly downward in the direction of box body transport. Two pieces of transparent side board 16 are installed vertically at the left and right sides of the main frame 11, respectively.

The pair of opposing side belts 15 are wrapped between and around shaft supported pulleys 22, located at the front and back ends of left and right belt width adjusting frames 21. The pulleys 22 are driven by geared motors with electromagnetic breaks 23. The motors are installed under the back end of each belt width adjusting frame 21. The operating width between the left and right belt adjusting frames 21 is adjusted by a pair of adjustment screws 26, note FIG. 4. The adjustment screws on the left and right sides are threaded in opposite directions and are attached at the front and back portions of each belt width adjusting frame 21. The screws 26 insert into projected threaded parts 24 installed under the belt width adjusting frames 21, and are rotated by a belt width adjusting handle 25, note FIG. 3. When one of the screws 26 is rotated, the other screw also rotates in the same direction by means of an interlocking chain mechanism 27, note FIG. 4. Accordingly, the distance between the frames 21 is made wider or narrower so that the pair of side belts 24 can always be positioned at equal distance from a center line of the apparatus.

A stop member 28 is attached at the center line of the conveyer 12, note FIGS. 3 and 4. The stop member is operable to move vertically by means of an air cylinder (not shown in the drawing) along a guide 29. When engaged, the stop 28 lifts up from the box body transporting surface of the conveyer 12.

A support column 31, note FIG. 3, is installed at one side of the main frame 11. The support column 31 is attached to an up and down adjusting table 33, which moves freely up and down by means of a screw. The screw is rotated by a height adjustment handle 32 and two perpendicular guide rods (not shown in drawing). A main head body 36, note FIG. 4, for a tape head 35 is installed on a mounting plate 34. A front, inner flap push down body 37, composed of a longitudinal, thin, flat plate, and is installed at a top edge of the main head body 36 so as to face the direction of box body transport. This position corresponds to the central portion of the box body 1.

The front, inner flap, push down body 37 faces an incoming box body slightly above the base of the front inner flap 3*a*. This is the leading flap in the transport direction, after the box body 1 is stopped by the stopper 28. A roller 38 is installed at the top of the inner flap, push down body 37 so as to make contact with the front inner flap 3*a* at the beginning of folding. The front inner flap push down body has an inclined area 39 under the roller 38. The inclined area 39 is inclined downward in the direction of box body transport. Accordingly, the roller 38 and the inclined area 39 function to fold the front inner flap 3*a* into the top opening plane of the box body 1*a*.

Two horizontal guide rods 42, note FIG. 4, are attached as one unit to the up and down adjusting table 33 by means of a pair of mounting plates 41. Base end parts 44 of an L-shaped support plate 43 fit into the horizontal guide rods 42 by means of linear bushings 45 so as to transverse freely. Correspondingly, the base end parts 44 of the L-shaped support plate 43 fit into the upper part of a width adjusting shaft 47 by means of a linear bush 48 so as to move vertically. The width adjusting shaft 47 is installed on one side of the belt width adjusting frame 21 by a mounting plate 46, note FIG. 3. Therefore, the L-shaped support plate 43 can be adjusted transversely along with the belt width adjusting frame 21 by means of the width adjusting shaft 47, note FIG. 4. Accordingly, the L-shaped support plate 43 can be adjusted both vertically and transversely by interlocking with the height adjustment handle 32 and the belt width adjusting handle 25, note FIG. 3.

The back, inner flap, push down body includes a mounting plate 53, note FIG. 4 which is attached to a long groove 51 on the L-shaped support plate 43 by a screw 52. An air cylinder 54 is attached to the mounting plate 52. Another mounting plate 56 is attached to a rotary actuator 57 and moves horizontally and vertically by means of the air cylinder 54 and a pair of guide locks 55. A rotation shaft 58 of the rotary actuator 57 is set at a level slightly larger than the base of the back inner flap 3*b*. The rotation shaft 58 is attached to a lateral, flap-shaped back, inner flap, push down body 59. The back, inner flap, push down body 59 is rotated from an upward position to an almost horizontal position when folding the back inner flap 3*b* into the top opening plane of the box body. While the box body is being transferred, the back, inner flap, push down body 59 is retracted by the air cylinder 54 to a position in which box transport is not obstructed. The back inner flap push down body 59 then extends behind the back inner flap 3*b* of the box body 1 when the box body 1 is stopped by the stop member 28.

The back, inner flap, push down body 59 moves in a transverse direction along with shaft 58 by means of the air cylinder 54 from its original position at the right side, note FIG. 4, and is rotated by the rotary actuator 57 in a forward direction from a vertical position to a horizontal position. Accordingly, the back inner flap push down body 59 functions to fold the back inner flap 3*b* into the top opening plane of the box body 1.

The left and right, outer flap, push down bodies 72 include at their base ends a pair of air cylinders 63, note FIG. 3, which are shaft supported above the up and down adjusting table 33 by means of a support shaft 62, located between a bracket 61. The top ends of links 65 are connected by shafts (not shown in drawing) to the tips of piston rods 64 of the air cylinders 63. The bottom ends of each link 65 are connected to base end parts 68. The arm base end parts 68 are attached under the up and down adjusting table 33 so as to rotate freely by means of a pair of rotation shafts 67 supported by a pair of shaft receiving plates 66.

A pair of arms 71 project on the left and right from each arm base end part 68. Left and right outer flap push down bodies 72 are attached at the tips of each arm 71, respectively. The left and right, outer flap, push down bodies 72 are positioned at the upper area of the left and right side of the box body 1 after it is stopped by the stop member 28 and rotate downward around the shafts 67, located above the central part of the box body 1, to fold the left and right outer flaps 3*c* and 3*d* into the top opening plane of the box body 1.

The left and right, outer flap, push down bodies 72 function with roller shafts 74, installed parallel to the conveyer 12 at the tips of the arms 71 by means of shaft-supported plates 73. The roller shafts 74 carry a plurality of bearing rollers 75 fitted onto the roller shafts 74 so as to rotate freely. Sub-rollers 77 located at the tips of the arms 71 along the inner sides of the bearing rollers 75 are rotatably shaft supported by means of mounting plates 76. As shown in FIG. 6, the sub-rollers 77 commence folding of the left and right outer flaps 3*c* and 3*d*, while the bearing rollers 75 fold the left and right outer flaps 3*c* and 3*d* to a horizontal position.

The tape head, note FIGS. 3 and 7, which seals the facing edges of the left and right outer flaps 3*c* with a tape 5, is located behind the front, inner flap, push down body 37 in the forward direction of box body transport. The tape head is positioned to enable the tape head to face the center of the box body.

The tape head 35 includes head arm 82, which is bent in a semi-V shape, and is attached to the main head body 36 by a shaft 81 so as to rotate freely. Another head arm 84 is attached to the main head body 36 by a shaft 83. Shaft supported, sealing rollers 85 and 86 are located at the tips of each head arm 82 and 84. The bent part of one head arm 82 and the middle of the other head arm 84 are connected by a connection link 87. Both head arms 82 and 84 are interlocked and rotate in opposite directions back and forth. A coil spring 88 is attached to the base of one head arm 84, forcing both head arms 82 and 84 to be projected downward.

A cutter arm 92 is rotatably attached to the main head body 36 by a shaft 91. A tape cutting blade 93 is attached to the inner side of the tip 92*a* of the cutter arm 92. The cutter arm 92 is supplied with force by a tension coil spring 94 so as to enable the arm tip to project downward. A roller 95 is rotatably supported at the edge of the main head unit 36 where the front, inner flap, push down body 37 is installed.

As shown in FIG. 4, a tape mounting plate 96 is installed vertically at the upper part of the main head unit 36. A roll of single sided adhesive tape 5 is removably fitted into a rotational base attached to the top edge of the tape mounting plate 96. The tape 5 is threaded over guide rollers 97, 98, and 99, which are shaft-supported at the main head unit 36, note FIG. 7. The tape is pulled out at the side from which the box body enters until the tape end 5*a* reaches the level of one of the sealing rollers 85. The adhesive side of the tape faces the side from which the box enters.

Box Sealing Process

Figure 1:
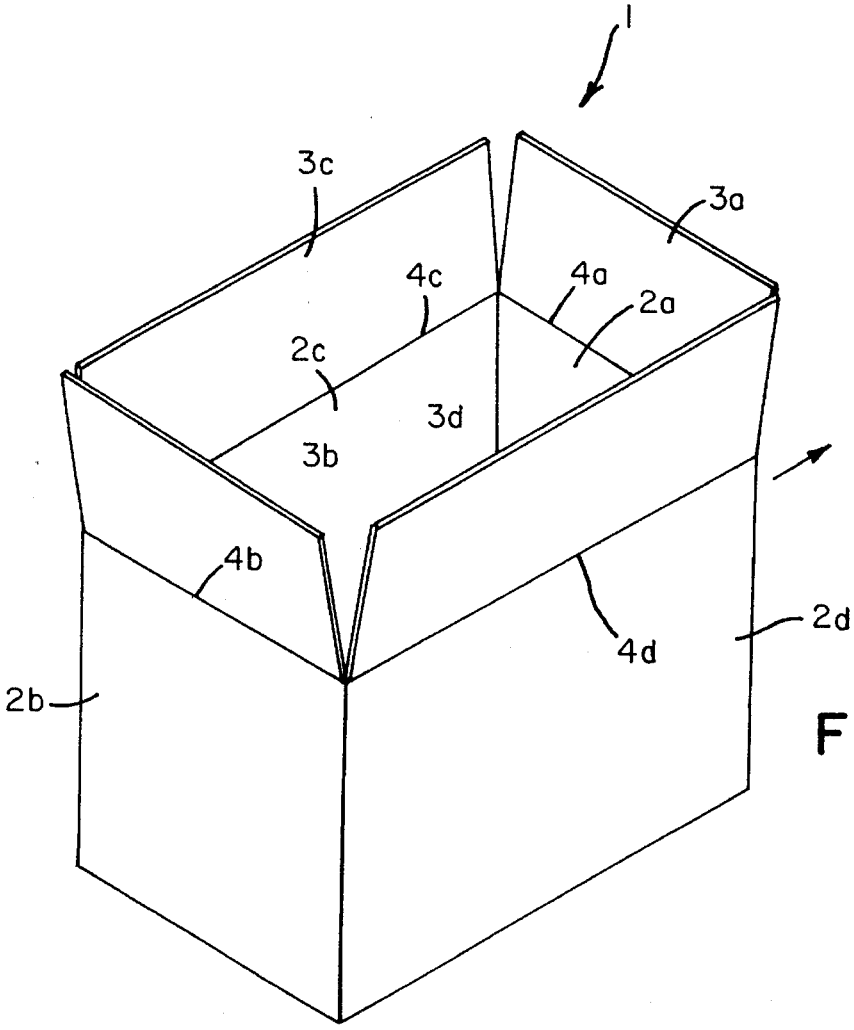
FIG. 1 is an axonometric view of a box body before being formed into a closed container by the subject box sealing apparatus.
Figure 2:
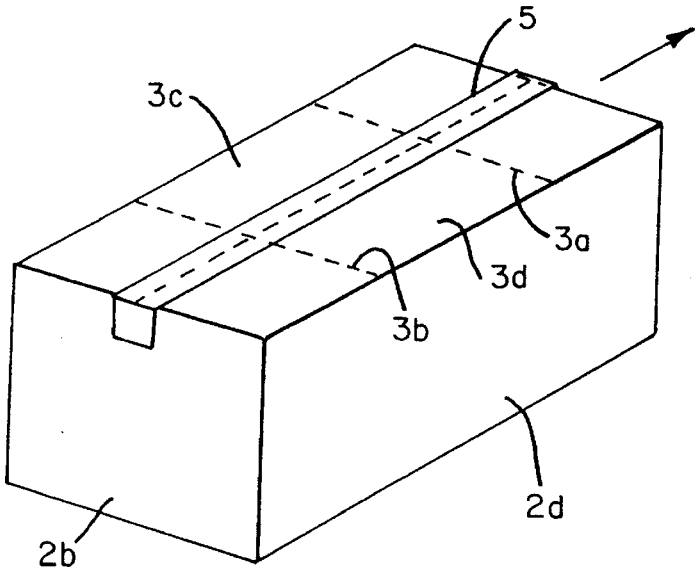
FIG. 2 is an axonometric view of the box body following formation into a closed container by the box sealing equipment.

The box body 1 with an open upper portion, note FIG. 1, is fed onto the conveyer 12. The box body 1 is caught at both sides by the side belts 15, which are inclined downward in the forward direction of box movement. The box is thereby transported to the stop member 28 while pressing down against a box body transportation surface composed of free rollers 14. Accordingly, the box body is prevented from lifting. The front end 2*a* of the box body 1 is stopped by the stop 28.

Figure 5:
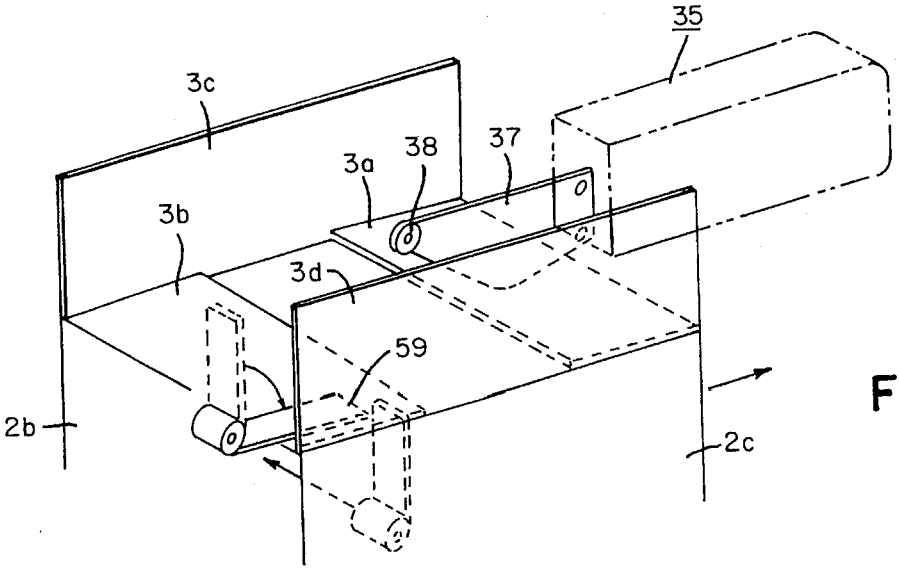

The back, inner flap, push down body 59 is retracted by the air cylinder 54 to a position in which transportation of the box body 1 is not obstructed. As shown in FIG. 5, the central part of the front inner flap 3*a* of the box body 1 is pushed down by the longitudinal, thin, flat front inner flap push down body 37, folding the front, inner flap 3*a* into the top opening plane of the box body.

The back, inner flap, push down body 59 is then extended behind the back inner flap 3*b* and is rotated downward by a rotary actuator 57 so as to become nearly horizontal, note FIG. 5. Accordingly, the lateral, flat back, inner flap, push down body 59 folds the back, inner flap 3*b* into the top opening plane of the box body.

The facing links 65 are reciprocally rotated in opposite direction by a pair of air cylinders 63, causing the left and right arms 71 to rotate downward around each rotation shaft 67, note FIG. 6. Therefore the bearing rollers 75 of the left and right flap push down bodies 72 are lowered while rotating along the surface of the left and right outer flaps, to fold the left and right outer flaps into the top opening plane of the box body 1.

The stop member 28 is then released and the box body 1 is forcibly transported by the pair of side belts 15 while the left and right outer flaps 3*c* and 3*d*, which are pushed down by the left and right, outer flap, push down bodies 72. The box body 1 is moved forward to the tape head 35, and the left and right outer flaps are sealed by the tape head 35. While the box is being transported, the lateral, flat back inner flap push down body 59, which is in a horizontal position, is effortlessly extracted between the back inner flap 3*b* and the outer flaps 3*c* of the box body 1.

The tape head 35 operates when the roller 95, note FIG. 7 makes contact with the area in which the left and right outer flaps 3*c* and 3*d* face so as to prevent them from lifting. One of the sealing rollers 85 applies and presses the adhesive side of the tape end 5*a* to the upper part of the front end 2*a* of the box body 1. As the box body is moved forward, this sealing roller is moved correspondingly to the facing edges of the left and right outer flaps 3*c* while resisting the coil spring 88, and rotates clockwise, from the perspective of FIG. 7. The tape 5, which is pulled out under the sealing roller 85, is applied and pressed onto the facing edges of the left and right outer flaps 3*c* and 3*d*. The tip 92*a* of the cutter arm 92, equipped with the tape cutting blade 93, is raised by the top surface of the outer flaps 3*c* and 3*d*. The other sealing roller 86, which is interlocked with the first sealing roller 85 by means of the connection link 87, also presses down the tape 5 adhered on the facing edges of the left and right outer flaps 3*c* and 3*d* as the box body 1 is moved forward. After the first sealing roller 85 is detached from the back end of the outer flaps 3*c* and 3*d*, the first sealing roller 85 maintains the raised position while the other sealing roller 86 makes contact with the top surface of the outer flaps 3*c* and 3*d*.

Accordingly, corresponding to the box body 1's movement, the tape 5 is pulled out under the sealing rollers 85 and 86 and is adhered by the sealing rollers 85 and 86 onto the area where the left and right outer flaps 3*c* face. The moment the tip 92*a* of the cutter arm 92 is detached from the back end of the outer flaps 3*c* and 3*d*, the cutter arm tip 92*a* is raised by the spring 94 and, at the same time, the tape cutting blade 93 is moved down and hits against the tape 5, which is stretched between the back end of the outer flaps 3*c* and 3*d* and the sealing roller 95 with tension, and cuts the tape 5. Therefore, the length between the tip 92*a* of the cutter arm 92 and the tip of the tape cutter blade 93 is equal to the length of the cut tape end which sticks out from the end of the outer flaps 3*c* and 3*d*.

Finally, when the other sealing roller 86 leaves the outer flaps 3*c* and 3*d*, the head arm 84 rotates counterclockwise, from the perspective of FIG. 7, by action of the coil spring 88. The sealing roller 86 rolls down from the top edge of the back end 2*b*, note FIG. 2, of the box body 1 as if chasing the back end 2*b*, and presses the cut end of the tape 5 on the back end 2*b* of the box body 1 to complete taping.

Summary of Major Advantages of the Invention

Without attempting to detail and enumerate all of the advantages specifically and inherently disclosed in the foregoing application specification, those skilled in the art will recognize several features which provide an enhanced degree of utility of the subject invention.

The invention utilizes a stop member to stop a box body prior to folding the back inner box flap and the left and right outer box flaps. Accordingly, the box sealing equipment is smaller and more efficient than conventional models in both design and operation. Additionally, the lateral, flat back inner flap, push down, body creates less motion than conventional swinging type back, inner flap, folding mechanisms. Accordingly, the box sealing equipment is safer for operators.

The bearing rollers used in the left and right outer push down bodies rotate on the surface of the left and right outer flaps, producing less friction that conventional box sealing equipment. Accordingly, the left and right outer flaps are folded smoothly into the top opening plane of the box body and are less likely to be twisted, folded inaccurately, and sealed in improper form.

In describing the invention, reference has been made to preferred embodiments and illustrative advantages of the invention. Those skilled in the art, however, and familiar with the instant disclosure of the subject invention, may recognize additions, deletions, modifications, substitutions, and/or changes which fall within the purview of the subject invention and claims.

What is claimed is:

1. A box closing and sealing apparatus operable to close and seal the top of a box having a body with an upper open portion, front inner box flap, back inner box flap, and left and right outer box flaps, said box sealing apparatus comprising:

a frame;

means operably connected to said frame for conveying the box body along a conveyance path;

a stop member movable between a retracted position removed from said conveyance path and a blocking position;

means operably connected to said frame for folding the front inner box flap into an upper opening plane of the box body, said front inner box flap folding means including a body positioned generally above and at a generally central position of said conveyance path such that as said box body is advanced along said conveyance path, said body of said front inner box flap folding means contacts said front inner box flap;

means operably connected to said frame for folding the back inner box flap into the upper opening plane of the box body, said back inner box flap folding means movable between a position removed from said conveyance path to a generally central position of said conveyance path;

means operably connected to said frame for folding the left and right outer box flaps into the upper opening plane of the box body, said means for folding the left and right outer flaps including opposed first and second body members movable between opposing positions lateral to said conveyance path of said box body and a opposing positions slightly above and adjacent to a generally central position of said conveyance path such that when said first and second body members are caused to move from said opposed lateral positions to said position adjacent a generally central position of said path, said left and right outer flaps are cause to occupy a position across said upper opening plane of said box body; and means operably connected to said frame for sealing facing edges of the left and right outer flaps after said left and right outer flaps are moved into said position across said upper opening plane of said box body.

2. A box closing and sealing apparatus as defined in claim 1 wherein said means operably connected to said frame for sealing comprises a sealing frame and means for securing a roll of adhesive tape to said sealing frame.

3. A box closing and sealing apparatus as defined in claim 2 wherein the body of said front inner box flap folding means is operably secured to said sealing frame.

4. A box closing and sealing apparatus as defined in claim 1 wherein said body of said front inner box flap folding means comprises:

an elongate member positioned longitudinally along said conveyance path, said elongate member having a relatively thin lateral dimension so as to define a flap contact edge, said contact edge sloping downward from a distal point of said body.

5. A box closing and sealing apparatus as defined in claim 4 wherein said front inner box flap folding means further comprises a roller operably secured at said distal point of said body.

6. A box closing and sealing apparatus as defined in claim 1 further comprising:

a vertical support member operably connected to said frame;

a support table operably engaged to and movable along said vertical support member such that said support table can be positioned above said box body conveyance path at a location depending on the size of a box body;

whereby said means for folding the back inner box flap and said means for folding the left and right outer box flaps are operably connected to said support table.

7. A box closing and sealing apparatus as defined in claim 6 further comprising:

an elongate support member operably engaged to said support table such that said elongate support member is movable along an axis transverse to a longitudinal axis of said conveyance path, said elongate support member extending from said support table in an upstream direction;

whereby said means for folding the back inner box flap is operable engaged to said elongate support member.

8. A box closing and sealing apparatus as defined in claim 7 wherein said elongate support member comprises an L-shaped member having a longitudinal groove such that said means for folding the back inner box flap is movable along said elongate member.

9. A box closing and sealing apparatus as defined in claim 1 wherein said means for folding the back inner box flap further comprises:

a support member operably attached to said frame and movable between a position lateral to said conveyance path to a position generally at a midsection of said conveyance path;

a mounting plate operably engaged to said support member;

a body member operably attached to said mounting plate and rotatable about an axis transverse to a longitudinal axis of said conveyance path such that when said body member rotates about said transverse axis it causes a back inner box flap to occupy a position across an upper opening plane of a box body.

10. A box closing and sealing apparatus as defined in claim 6 wherein said means for folding the left and right outer box flaps further comprise:

opposed arms operably engaged to said support table such that said opposed arms rotate about an axis parallel to a longitudinal axis of said conveyance path;

a plurality of roller members operably secured to distal portion of said opposed arms;

whereby when said opposed arms are rotated about said parallel axis, said plurality of roller members contact a respective left and right outer box flap and move said left and right flaps to a position across the upper opening plane of said box body.

11. A box closing and sealing apparatus as defined in claim 1 wherein said means for conveying the box body comprises:

a conveyor table including a plurality of rollers; and a first left side belt and a second right side belt for engaging respective side surfaces of a box body, said first and second side belts inclined downward in the direction of conveyance.

12. A box closing and sealing method operable to close and seal the top of a box comprising the steps of:

(a) conveying a box body having a body with an upper open portion, front inner box flap, back inner box flap, and left and right outer box flaps toward a box flap folding station;

(b) abutting the box against a stop member at the box flap folding station;

(c) during step (a), folding the front inner flap of the box body into the upper opening plane of the box including the step of moving the front inner flap against a front inner flap folding body located generally above the box body and at a generally central portion thereof;

(d) folding the back inner flap of the box body into the upper opening plane of the box body including the step of positioning a back inner flap body at a position adjacent the back inner flap of the box and causing the back inner flap body to move such that the back inner flap is folded into the upper opening plane of the box body;

(e) folding the left and right outer flaps into the upper opening plane of the box body including the step of positioning respective left and right outer flap push down bodies lateral to and above the box flap folding station and moving the left and right outer flap push down bodies so as to fold the respective left and right outer flaps into the upper opening plane of the box body;

(f) conveying the box from the box flap folding station including the step of conveying the opposed left and right outer flaps, while in their position across the upper portion of the box body, to a position adjacent a sealing unit; and (g) sealing the face edges of the left and right outer flaps with tape.

* * * * *